219-121 SR
3/17/87 XR 4,649,858

United States Patent [19]
Sakai et al.

[11] Patent Number: 4,649,858
[45] Date of Patent: Mar. 17, 1987

[54] REPAIRING APPARATUS FOR FURNACE WALL

[75] Inventors: Toshihiko Sakai; Yuji Narita, both of Amagasaki, Japan

[73] Assignee: Sumitomo Metal Industries, Ltd., Osaka, Japan

[21] Appl. No.: 785,659

[22] Filed: Oct. 9, 1985

[30] Foreign Application Priority Data

Oct. 12, 1984 [JP] Japan ..... 59-214816

[51] Int. Cl.[4] ..... B05B 7/20; B05B 7/22

[52] U.S. Cl. ..... 118/697; 118/696; 118/713; 118/308; 118/317; 219/121 PL; 219/121 PU; 219/121 PV; 427/34; 427/423; 264/30; 239/81; 239/227

[58] Field of Search ..... 118/696, 697, 713, 308, 118/317; 219/121 PL, 121 PU, 121 PV; 427/423, 34, 427, 140, 236; 264/30; 239/81, 132.3, 290

[56] References Cited

U.S. PATENT DOCUMENTS 4,107,244 8/1978 Ochiai ..... 264/30
4,187,409 2/1980 Slater ..... 219/121 PV
4,218,989 8/1980 Fujita ..... 118/713
4,291,217 9/1981 Braun ..... 219/121 PU
4,301,998 11/1981 Rodway ..... 118/713
4,337,897 7/1982 Höffken ..... 239/227

FOREIGN PATENT DOCUMENTS 39-14375 7/1964 Japan ..... 219/121 PU
58-49889 3/1983 Japan .

*Primary Examiner*—Shrive P. Beck
*Attorney, Agent, or Firm*—Burns, Doane, Swecker & Mathis

[57] ABSTRACT

This invention relates to a repairing apparatus for an industrial furnace wall using a plasma spray gun. The plasma flame of the gun traces the damaged part to be repaired by moving the gun in three-dimensional directions (up-and downwardly, right-and leftwardly, and forwardly and backwardly) relative to the furnace wall to be repaired. Furthermore, the optimum spray distance of the plasma flame follows the unevenness of the furnace wall and the depression extent of a damaged part to be repaired from the sound surface of a furnace wall by changing the mixture ratio of the operation gas for the gun to control the length of the plasma flame.

16 Claims, 8 Drawing Figures

REPAIRING APPARATUS FOR FURNACE WALL

BACKGROUND OF THE INVENTION

1. Field of the Invention

The present invention relates to a repairing apparatus for a damage internal wall (refractory lining) of an industrial furnace such as coke ovens and refinery furnaces.

2. Prior Art

The internal wall of an industrial furnace such as coke ovens and refinery furnace is constituted by lining a refractory material such as firebrick thereon. However, the internal wall of the industrial furnace is repeatedly exposed to high temperatures of 1,000° C. or more, so that not only it is thermally damaged by high temperature substances but also the damages such as cracks and separation are produced on it by the repeated expansion and contraction. Therefore, the effective repair of the above described thermal damage, crack, separation and the like of the internal wall of a furnace under a safe environment is an important problem in the operation of an iron works having such industrial furnaces.

The repair of the internal wall of the above described industrial furnace has been carried out by a wet repairing process in which a repairing material, which is a formless refractory material prepared by mixing binders, is sprayed onto damaged parts by means of a spraying apparatus inserted into the furnace through a furnace inlet or a spraying apparatus brought into the furnace by an operator once stopping the operation of the furnace. However, in this wet process, in order to give the repairing material a sprayable condition, binders which contain water are mixed to give high viscosity. Accordingly, when the repairing material sprayed onto the damaged parts is heated after application, water contained in the binders is explosively evaporated according to circumstances thereby the repaired parts are separated. Also, when the binders are insufficiently blended with the repairing material and the binders are not uniformly distributed, the adherence of the repairing material to the furnace wall is not uniform. In addition, the problem has occurred in that only the parts adjacent to the furnace inlet can be repaired and the like.

A dry repairing process, in which metallic or semi-metallic minute particles as repairing material are thermally flame sprayed or sprayed along with an oxidizing gas and the metallic or semi-mettalic repairing material is sintered by heat generated at that time, has been known for a process of solving the problem incidental to such wet repairing process. In comparison with the wet process, this dry repairing process has the advantages in that the binder is not required whereby having no effect by water contained in the binder. Furthermore, a flame or a gas stream used for spraying is diffused, so that the dry repairing process is suitable for adhering a large amount of repairing material to a wide range. However, in the case that it is necessary to repair narrow damages such as cracks and those in a joint portion of firebrick with high accuracy, the repairing material is adhered also to the surroundings of the damaged parts to form projections within the furnace wall. Under such condition, in coke ovens, a hindrance is occurred in the pushing-out of coke, so that the dry repairing process is unsuitable for the operation of the furnace. Also, in the same manner as in the above described wet repairing process, the problem that only the portion adjacent to the furnace inlet can be repaired can not be solved.

In view of the above described circumstances, the present inventors disclosed a repairing process of an internal wall of a furnace utilizing the plasma spraying in Japanese Patent Application Laid-Open No. 58-49889 (1983).

This invention consists in that an operation gas which is added $N_2$ as to Ar gas generates a plasma jet and the powders of refractory materials such as ceramics as a repairing material are thermally sprayed onto a furnace wall with heating the furnace wall by the resulting plasma jet. Since this invention relates to a dry repairing process in which the powders of refractory materials such as ceramics are used for the repairing material, the disadvantages, such as an explosive evaporation of water, incidental to the wet repairing process can be eliminated. Also, since a flame of plasma jet can be made narrow, this process is suitable for the case where it is necessary to spray the repairing material with high accuracy onto only the narrow damaged parts such as cracks. In addition, this process has advantages in that the repairing material shows a strength nearly equal to that of a brick upon its thermal spraying; the bond strength between a brick constituting the furnace wall and the repairing material is great since they are welded to each other; the repairing material is compact and impermeable to a gas such as water vapour and CO gas after welding; there is little influence upon the furnace wall since the welded part of repairing material is not rapidly chilled; the degree of freedom of the selection and combination of repairing materials is comparatively large; and the like.

However, if the repair of an internal wall of furnace can be carried out without lowering a temperature of the furnace so much, ideally at usual operating temperatures, it is remarkably advantageous in respect of operational efficiency, energy efficiency and the like. On this account, the repair has been carried out by means of a spraying apparatus or a spray gun brought into the furnace by an operator once stopping the operation of the furnace but it has been desired to realize the remote controlled-repairing operation in view of safety, improvement in working circumstance and possibility of carrying out the repair in the depth of the furnace.

In view of these circumstances, in order to remote control a spray gun and the like, for example Japanese Patent Application Laid-Open No. 53-82802, Japanese Patent Publication No. 57-48611 and the like in which the position of a spray gun is controlled by the visual observation and Japanese Utility Model Publication No. 57-46360 and the like, in which the outline of the positional relation between a damaged part of a furnace wall and a spray gun is read by one image pickup apparatus inserted into a furnace to control the position of the spray gun, have been proposed. However, since an object to be controlled is a usual spray gun in these inventions and utility models, the control need not be high in accuracy, so that their application to the plasma spraying, in which a repairing material can be thermally sprayed with high accuracy, is not effective practically.

So, the present inventors disclosed also a method of controlling the position of a spray gun and the like three-dimensionally using two television cameras and a laser spot ray-radiating apparatus in abovementioned Japanese Patent Application Laid-Open No. 58-49889. However, also in this method, an art for remote controlling a spray gun with high accuracy is required from angles that the value based on the result obtained from the experiments, which were preliminarily carried out, is used as the optimum distance between the spray gun and the furnace wall; in the case of plasma spraying, the distance between the spray gun and the furnace wall have a great influence upon the adhesion efficiency of a repairing material such as ceramics; the advantage of being capable of repairing narrow parts of a furnace wall such as cracks with high accuracy can be effectively utilized by using the plasma spraying; and the like.

OBJECT OF THE INVENTION

The present invention was achieved in view of the above described circumstances and it is a first object of the present invention to provide a repairing apparatus for a furnace wall in which a repairing material can be thermally sprayed onto only narrow damaged parts of a furnace wall surface such as cracks to repair the furnace wall.

It is a second object of the present invention to provide a repairing apparatus for a furnace wall with a high adhesion efficiency of repairing material but without occurring the separation, a phreatic explosion and the like.

It is a third object of the present invention to provide a repairing apparatus for a furnace wall in which it is unnecessary to lower a temperature of the furnace much in the repairing process, that is to say a "hot repairing" is possible, thereby not lowering the operation efficiency of the furnace.

It is a fourth object of the present invention to provide a repairing apparatus for a furnace wall in which an operator is not forced to carry out a repairing operation under a bad environment.

It is a fifth object of the present invention to provide a repairing apparatus for a furnace wall in which even a damaged part of the furnace wall in the depth of the furnace invisible from the outside of the furnace can be repaired.

It is a sixth object of the present invention to provide a repairing apparatus for furnace wall in which a lifetime of the furnace can be prolonged.

It is a seventh object of the present invention to provide a repairing apparatus for a furnace wall which is easy to operate.

The above and further objects and features of the invention will more fully be apparent from the following detailed description with reference to accompanying drawings.

DETAILED DESCRIPTION OF THE INVENTION

The preferred embodiment of the present invention will be described below with reference to the attached drawings.

Figure 1:
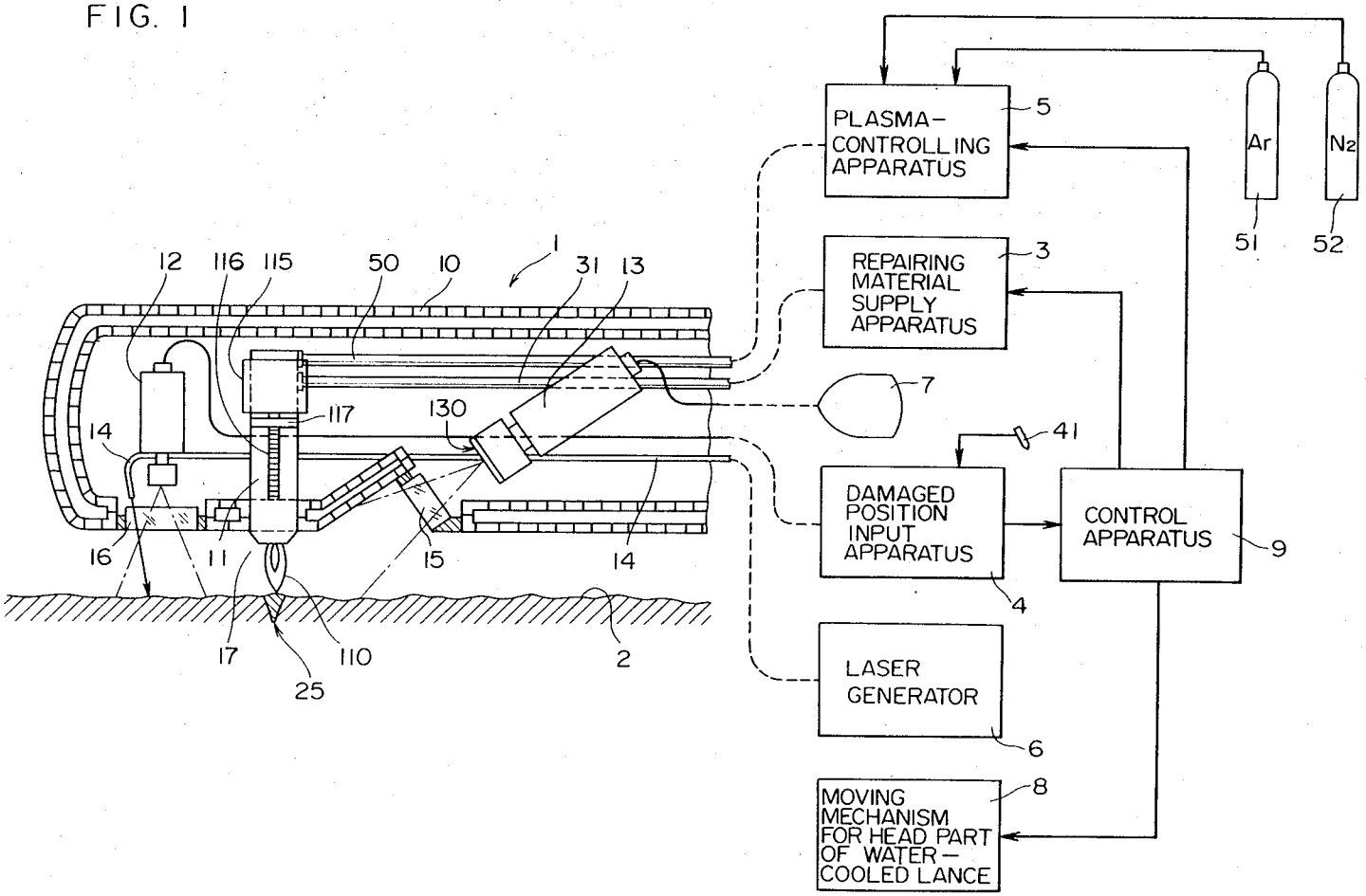
FIG. 1 is a schematic view showing the construction of a head part of a water-cooled lance.

Referring now to FIG. 1 which is a schematic view showing the construction of a head part of a water-cooled lance 1 of a repairing apparatus for a furnace wall according to the present invention, the head part of the water-cooled lance 1 is adapted to be rotatable along a vertical plane as described later but, in FIG. 1, a section vertically to the rotating plane is shown and the rotation is carried out in the direction toward the depth as vewed in the drawing.

The head part of the water-cooled lance 1 is adapted to shelter and protect the instruments provided in the apparatus from high temperatures by circulating a cooling water in a metallic double-constructed cooling case 10. The head part of the water-cooled lance 1 is provided with a plasma spray gun 11, a television camera 12 for observing a furnace wall which is an image pickup apparatus for observing a furnace wall 2, a television camera 13 for observing a jet flame 110 of the plasma spray gun 11, a light-guide 14 for projecting a laser beam on the furnace wall 2 in order to determine a distance between the plasma spray gun 11 and the furnace wall 2 by the triangulation, and the like therein at the positions closer to the front end thereof.

An optical axis of the television camera 12 for observing a furnace wall and a plasma jet-spraying direction (a direction of flame) of the plasma spray gun 11 are set so as to be vertical to the rotating plane of the head part of the water-cooled lance 1 and an optical axis of the television camera 13 for observing a flame and a laser beam-projecting direction of the light-guide 14 are set so as to be disposed on a plane being vertical to the rotating plane of the head part of the water-cooled lance 1. Also, the head part of the water-cooled lance 1 is connected to an arm 18 (refer to FIG. 3) at a base end portion thereof (the right-hand side as viewed on the drawing). The arm 18 is pivotally supported on the lower end of an elevating mechanism 81 mounted on moving mechanism 8 for the head part of the water-cooled lance 1, the plasma spray gun 11, the television cameras 12, 13 and the like being adapted to be rotatable in parallel to the furnace wall 2 under the condition facing to the furnace wall 2.

In addition, a nozzle portion of the plasma spray gun 11 is projected outward from a small hole 17 opened at a position of the cooling case 10 facing to the furnace wall 2 together with a repairing material supply pipe 31 described later. The plasma spray gun 11 is movable in the direction toward the furnace wall 2, that is to say the radiating direction of the jet flame 110. That is to say, the head part of the water-cooled lance 1 is provided with a motor 115 therein on one side portion of the plasma spray gun 11 with holding an output shaft in a direction (toward the furnace wall 2) vertical to the rotating plane of the head part of the water-cooled lance 1, a threaded rod 116 being connected to an output shaft of the motor 115. On the other hand, the plasma spray gun 11 is provided with a nut-like member 117 projecting on one side portion thereof, the threaded rod 116 connected to the output shaft of the motor 115 being screwed in the nut-like member 117. Thus, upon drive of the motor 115, the threaded rod 116 is rotated to move the plasma spray gun 11 toward the furnace wall 2. Furthermore, three limit switches are provided at both end portions and the central portion of a moving range of the plasma spray gun 11 respectively, whereby the position of the plasma spray gun 11 relative to the head part of the water-cooled lance 1 can be changed in three stages.

Furthermore, the cooling case 10 is provided with windows 15, 16 made of heat-resisting glass and the like at the positions thereof facing to the furnace wall 2. The window 15 is adapted to face to a view field of the television camera 13 for observing a flame while the window 16 is adapted to face to a common view field of the television camera 12 for observing a furnace wall and the light-guide 14. In addition, the television camera 13 for observing a flame is provided with a light quantity-reducing filter 130 for taking an image with reducing a light quantity of the flame 110.

The plasma spray gun 11 is supplied with a repairing material from a repairing material supply apparatus 3 and plasma operation gas from a plasma-controlling apparatus 5. The repairing material supply apparatus 3 supplies a nozzle portion of the plasma spray gun 11 with repairing material such as $SiO_2$, $Al_2O_3$, $ZrO_2$, MgO, CaO and SiC through a repairing material-supply pipe 31 and is provided with a supply quantity-controlling valve (not shown).

Also, the plasma-controlling apparatus 5 mixes Ar gas 51 and $N_2$ gas 52 and supplies the plasma spray gun 11 with the resulting mixture through an operation gas-supply pipe 50.

An image picked up by the television camera 12 for observing the furnace wall 2 is transmitted to a damaged position input apparatus 4 and displayed. Data of the position of a damaged part 25 is input and stored in a control apparatus 9 by indicating the position of the damaged part 25 on a display of the damage position input apparatus 4 with a light-pen 41.

A laser beam projected from the light-guide 14 is radiated by a laser generator 6. That is to say, the laser beam generated by the laser generator 6 is transmitted to the head part of the water-cooled lance 1 through the light-guide 14 and projected into a view field of the television camera 12 on the surface of the furnace wall 2 from a front end of the light-guide 14 through the window 16.

An image picked up by the television camera 13 for observing a flame is displayed on a monitor 7.

Each of the above described instrument is controlled by a control apparatus 9. That is to say, the control apparatus 9 controls a moving mechanism 8 to make a flame of the plasma spray gun 11 follow the damaged position of the furnace wall 2 which is input from the damaged position input apparatus 4 and stored in the control apparatus. Also, the control apparatus 9 controls the plasma-controlling apparatus 5 to change a mixing ratio of Ar gas and $N_2$ gas whereby controlling a flame length of the plasma spray gun 11. In addition, the control apparatus 9 controls the repairing material supply apparatus 3 to supply with repairing material.

Furthermore, 8 is a moving mechanism for the head part of the water-cooled lance 1 which is below described.

Figure 2:
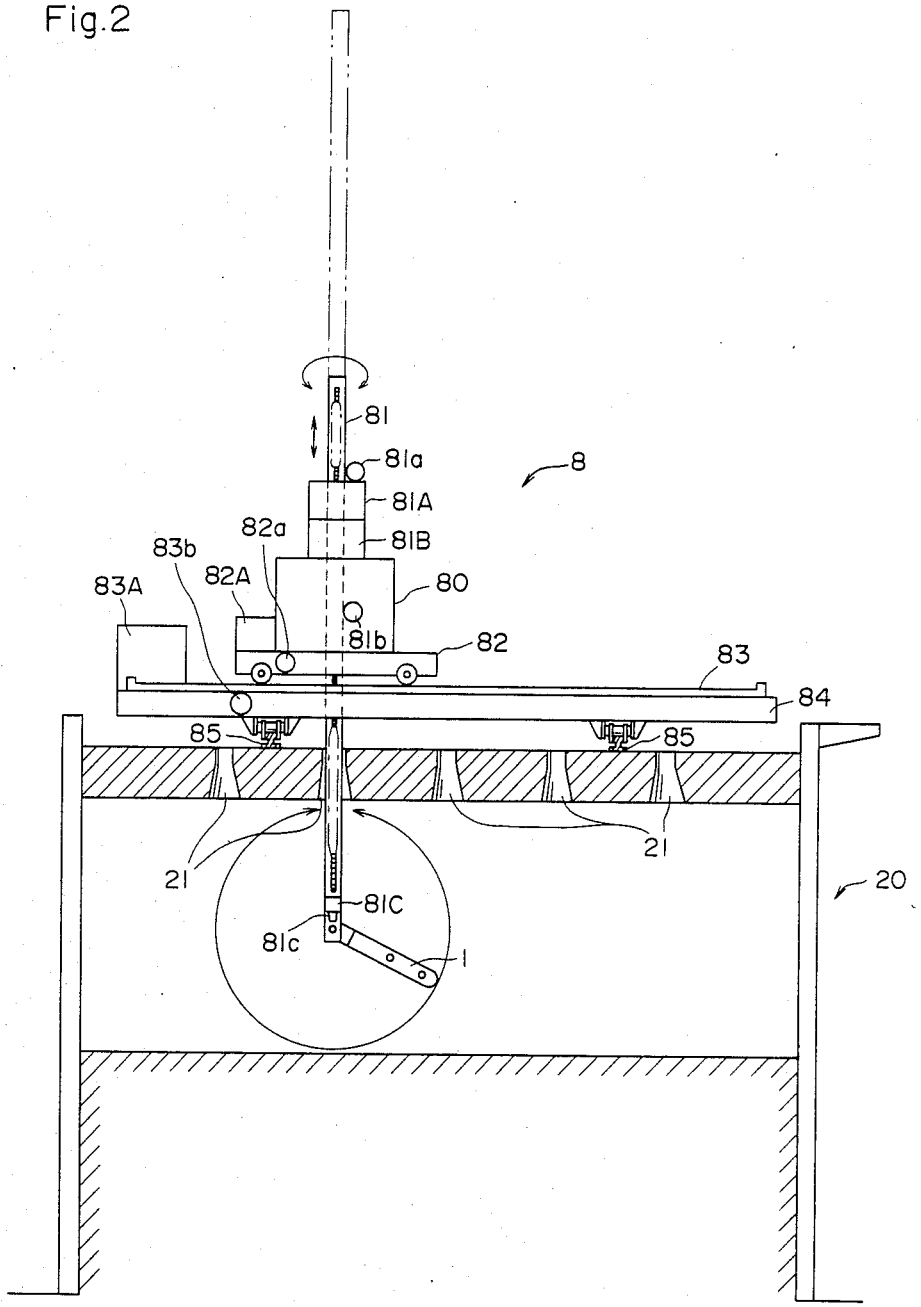
FIG. 2 is a schematic view showing the construction of a moving mechanism.

FIG. 2 is a schematic view showing the construction and using condition in a coke oven 20 of the moving mechanism 8 of the above described head part of the water-cooled lance 1, a side section, in which a longitudinal direction of the coke oven 20 is revealed, being shown.

The moving mechanism 8 comprises a moving base 84 travelling on the upper surface of the coke oven 20 in the direction of width of the coke oven 20, a truck 82 travelling on the moving base 84 in the longitudinal direction of the coke oven 20, a manipulator 80 carried on the truck 82, an elevating mechanism 81 for the head part of the water-cooled lance 1 installed on the manipulator 80 and the like.

The manipulator 80 is carried on the truck 82 and provided with the elevating mechanism 81 for the head part of the water-cooled lance 1 at the central portion as viewed on a plan thereof so that the elevating mechanism 81 is moved up and down by means of an up and down driving apparatus 81A and rotated in the horizontal direction by means of a rotary driving apparatus 81B while supporting the elevating mechanism 81. The position of the elevating mechanism 81 in the up and down direction relative to the manipulator 80 is detected by a sensor **81*a* and the rotation angle by a sensor 81*b* and given to the control apparatus 9**.

The truck 82 is so adapted that it can be moved on two rails 83, 83 laid laterally (in the longitudinal direction of the coke oven 20) as viewed on FIG. 2 on the moving base 84 by means of a driving apparatus 82A. The moving base 84 is adapted so that it can be moved on two rails 85, 85 laid on the upper surface of the coke oven 20 in the direction of depth as viewed on FIG. 2 (the direction vertically to the rails 83, 83 on which the truck 82 travels, that is to say the direction of width of the coke oven 20) by means of a driving apparatus 83A. Accordingly, the manipulator 80 can be moved on the upper surface of the coke oven 20 in both the direction of length and the direction of width of the coke oven 20. The travelling position of the truck 82 is detected by a sensor **82*a* while the travelling position of the moving base 84 is detected by a sensor 83*b*. The detected results of the sensor 82*a* and 83*b* are given to the control apparatus 9**.

The elevating mechanism 81 is supported on the manipulator 80 with the longitudinal direction as the vertical direction, as described above, whereby being rotated in the horizontal direction and moved up and down.

Figure 3:
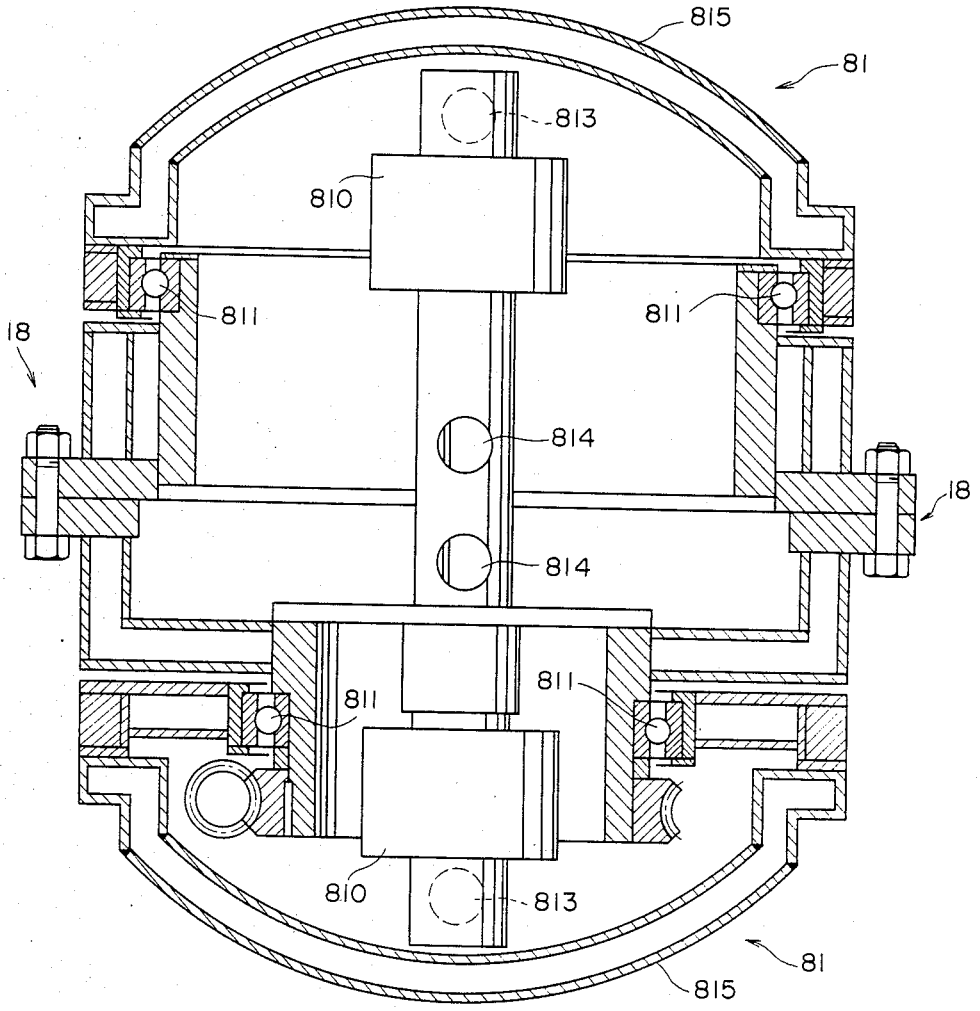
FIG. 3 is a sectional view showing the construction of a joint portion of the head part of a water-cooled lance and an elevating mechanism.
Figure 4:
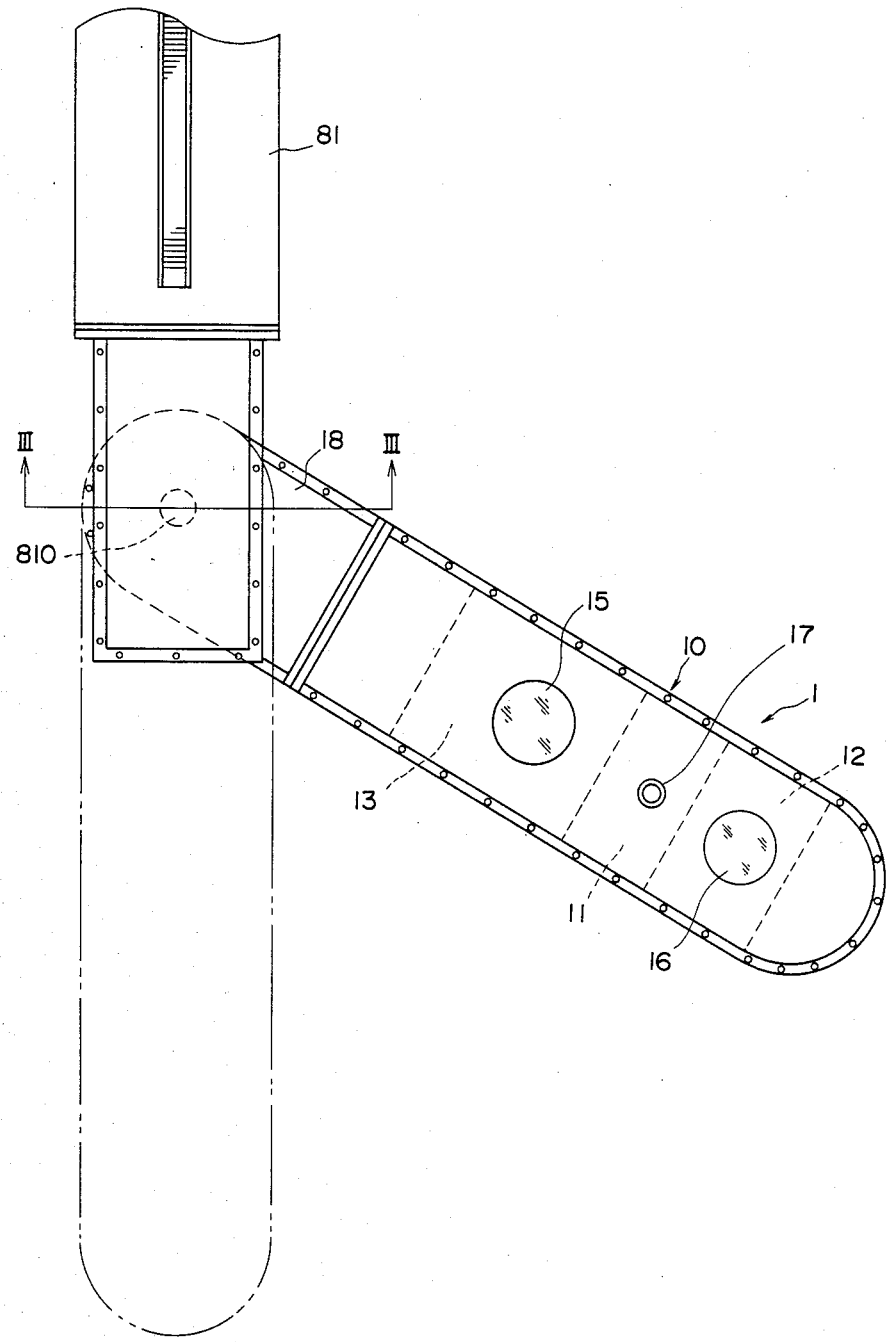
FIG. 4 is an external view showing the joint portion as shown in FIG. 3.

The elevating mechanism 81 supports the base end portion of the head part of the water-cooled lance 1 pivotally supported at the lower end thereof rotatably in the vertical plane. FIG. 3 (sectional view) and FIG. 4 (side view) are schematic views showing the construction of a joint portion of the head part of the water-cooled lance 1 and the elevating mechanism 81. FIG. 3 is a sectional view of FIG. 4 taken through the line III—III thereof under the condition that the head part of the water-cooled lance 1 is at the position shown by an imaginary line in FIG. 4, that is to say both longitudinal directions of the head part of the water-cooled lance 1 and the elevating mechanism 81 coinside.

The elevating mechanism 81 is forked off in two at the lower end portion, an arm 18 connected to the base end side of the head part of the water-cooled lance 1 is pivotally supported on this forked portion in such a manner that it is put in the forked portion. That is to say, the arm 18 is provided with a swivel joint 810 having a direction vertical to the longitudinal direction of the head part of the water-cooled lance 1 as an axial direction at a position closer to the base end thereof. On the other hand, the elevating mechanism 81 is provided with a bearing 811 having a horizontal direction as the axial direction thereof. The swivel joint 810 is supported on this bearing 811.

With the above described construction, the head part of the water-cooled lance 1 is rotatable in a vertical plane parallel to the furnace wall 2 with the swivel joint 810 as the center under the condition that the plasma spray gun 11, the television cameras 12, 13 and the like face to the furnace wall 2. The swivel joint 810 is provided with cable-inlets 813, 813 opened at the portions projecting toward the elevating mechanism 81 side and cable-outlets 814, 814 opened at the portions of the arm 18 side, the cables of the light-guide 14, the television cameras 12, 13 and the like, the repairing material supply pipe 31, the operation gas supply pipe 50 and the like are passed through the cable-inlets 813, 813 and cable-outlets 814, 814.

Also, the numeral 815 designates a cooling case for the elevating mechanism 81 constructed in the same manner as in a cooling case 10 for the head part of the water-cooled lance 1. In addition, 81C designates a driving apparatus provided at the lower end portion of the elevating mechanism 81, 81*c* designating a sensor for detecting a rotation angle of the head part of the water-cooled lance 1 relative to the elevating mechanism 81, and the detected result of the sensor 81*c* being given to the control apparatus 9.

On the other hand, the coke oven 20 is provided with a plurality of coal-charging ports 21, 21 . . . for charging the coke oven 20 with coal which is a raw material of coke on the upper surface thereof, the head part of the water-cooled lance 1 being inserted into the coke oven 20 through either of the coal-charging ports 21, 21 . . .

In addition, the travelling amount of the truck 82, the moving base 84 and the elevating mechanism 81, the rotation amount of the head part of the water-cooled lance 1 relative to the elevating mechanism 81 and the like being detected by the sensor 81*a* and the like, and these sensors being composed of a potentiometer, a digital scale and the like. The measurement result of the sensor 81*a* and the like are input in the control apparatus 9 so that the control apparatus 9 specifies the position of an image being picked up by the television camera 12 for observing a furnace wall on the basis of the measurement results.

As understood from the above description, with an apparatus of the present invention, the position on the furnace wall 2 to be thermally sprayed by the plasma spray gun 11 can be controlled in three-dimensional directions: the up and down direction and the horizontal direction owing to the rotational movement of the head part of the water-cooled lance 1 with the lower end portion of the elevating mechanism 81 as the center and the up and down movement of the elevating mechanism 81, and the direction vertical to the furnace wall 2 of the plasma spray gun 11 owing to the motor 115 but also the flame length of the plasma spray gun 11 may be controlled to control the position in the direction vertical to the furnace wall 2, as described later.

Next, the operation of an apparatus of the present invention constructed in the above described manner will be described. In the following description, it is supposed that the damaged part 25 is a narrow crack-like one.

At first, the manipulator 80 of the moving mechanism 8 for the head part of the water-cooled lance 1 is positioned directly above the coal-charging port 21 adjacent to the furnace wall 2, where it seems that the damaged part 25 exists, in the coke oven 20. Then, the elevating mechanism 81 is brought down through the coal-charging port 21 to insert the head part of the water-cooled lance 1 into the coke oven 20. When the head part of the water-cooled lance 1 is inserted into the coke oven 20, the head part of the water-cooled lance 1 is brought down into the coke oven 20 through the coal-charging port 21 with making a longitudinal direction of the head part of the water-cooled lance 1 coincide with a longitudinal direction of the elevating mechanism 81, that is to say the up and down direction to place both directions on one straight line.

Then, the longitudinal direction of the head part of the water-cooled lance 1 is made parallel to the furnace wall 2 by utilizing the up and down movement and the horizontal rotation of the elevating mechanism 81 together with the rotation of the head part of the water-cooled lance 1. The damaged part 25 is searched on an image picked up by the television camera 12 for observing a furnace wall 2 and regenerated in a damaged position input apparatus 4 and when the damaged part 25 to be repaired is found, data of the damaged position is stored first in the control apparatus 9 by means of the light-pen 41. The storage of the data of the position of the damaged part 25 is achieved by indicating the position of the damaged part 25 to be repaired, concretely, both ends or both ends and inflection points of the crack-like damaged part 25 on the image of the damaged position input apparatus 4 by means of the light-pen 41. That is to say, the control apparatus 9 detects the present position of the moving mechanism 8 (concretely, the manipulator 80) on the coke oven 20, the up and down position and the rotary position of the elevating mechanism 81 relative to the manipulator 80 and the rotary position of the head part of the water-cooled lance 1 relative to the elevating mechanism 81 to three-dimensionally specify the position of the image being picked up by the television camera 12 for observing a furnace wall relative to the furnace wall 2 on the basis of the detected points. Upon indication of the positions of both ends of the damaged part 25 by means of the light-pen 41, the control apparatus 9 specifies the positions as the positions on the image, whereby the control apparatus 9 stores the data of the position of the damaged part 25 on the furnace wall 2.

Thus, after the data of the position of the damaged part 25 was stored by the control apparatus 9 the practical repair is started.

In the practical repairing operation, the control apparatus 9 always detects a distance between the head part of the water-cooled lance 1 and the furnace wall 2 by the triangulation, in which the position of projecting a laser beam projected from the front end of the light-guide 14 in the direction from the optical axis of the television camera 12 onto the image of the television camera 12 is detected, (the angles of the optical axis of the television camera 12 and the angle of the laser beam to the furnace wall 2 are constant and a distance between the optical axis of the television camera 12 and the front end of the light-guide 14 is constant). On the basis of this detection result, the control apparatus 9 drives the motor 115 to move the plasma spray gun 11 in the direction vertical to the furnace wall 2, thereby the distance between the plasma spray gun 11 and the furnace wall 2 is adjusted to a value suitable for the plasma spraying.

The control apparatus 9 makes the elevating mechanism 81 move up and down or the head part of a water-cooled lance 1 rotate so that the jet flame 110 of the plasma spray gun 11 may be moved along the longitudinal direction of the damaged part 25.

However, in the plasma spraying process, if the distance between the plasma spray gun 11 and the surface of furnace wall 2 to be thermally sprayed (hereinafter referred to as merely a spray distance) is too large, the adhering efficiency of the material thermally sprayed, that is to say the repairing material is lowered while if the spray distance is too small, the furnace wall 2 is melted. Accordingly, a range between the too large distance and the too small distance is the optimum spray distance. That is to say, it is necessary only to keep the distance between the front end of a nozzle of the plasma spray gun 11 and the furnace wall 2 within the optimum spray distance. To this object, the plasma spray gun 11 is adapted to be movable in the direction vertical to the furnace wall 2 by means of the motor 115, as above described.

However, the furnace wall 2 has local uneven portions on the surface thereof for the most part and in general the damaged part 25 to be repaired is depressed more than the surrounding sound furnace wall 2 but the depression extent is not uniform. On the contrary, as described above, the plasma spraying has the optimum spray distance. On this account, the distance between the front end of the nozzle of the plasma spray gun 11 and the surface of the damaged part 25 to be practically sprayed does not become constant whereby an excellent repairing effect can not be achieved by merely adjusting the distance between the front end of the nozzle of the plasma spray gun 11 and the furnace wall 2 by means of the motor 115 to keep it constant.

On the other hand, as above described, the present inventors found that the mixture ratio of Ar gas and $N_2$ gas is used as the operation gas for the plasma jet, the optimum spray distance can be adjusted by changing the length of the plasma flame with adjusting the amount of the $N_2$ gas. It is the reason of this that a factor, which has a greatest influence upon the heated condition of powders of the spraying material sprayed by the plasma flame and the heated condition of a substrate in the plasma spraying process, is the operation gas, in other words the heated and melted condition of the spraying material can be controlled by adjusting the composition and amount of the operation gas whereby a coating of the spraying material can be formed uniformly regardless of the change in distance between the front end of the nozzle of the plasma spray gun and the object to be sprayed.

Figure 5:
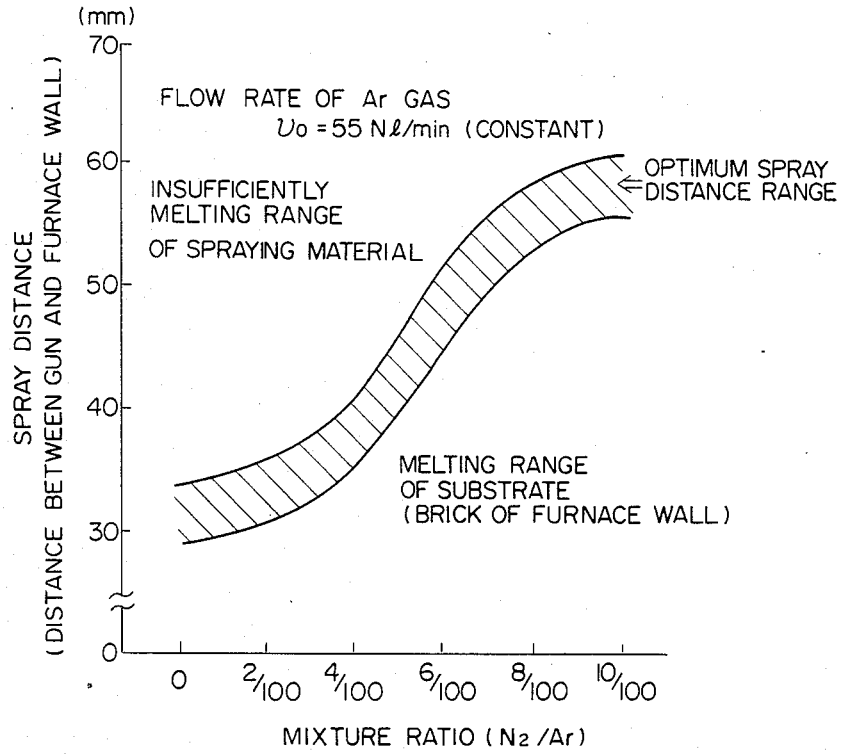
FIG. 5 is a graph showing a relation between a component ratio of a plasma jet operating gas and a flame length.

FIG. 5 is a graph showing experimental results obtained by the present inventors in order to establish a relation between the quantity of $N_2$ gas (the secondary gas) to Ar gas (the primary gas) and the spray distance. The experimental results for an off-line in the case where Roseki ($SiO_2$:78%, $Al_2O_3$:22%) firebrick powders are thermally sprayed as the repairing material onto the furnace wall formed of silica ($SiO_2$) brick are shown. An axis of ordinate shows the spray distance, an axis of abscissa showing a mixture ratio of $N_2$ gas to Ar gas of the operation gas for the plasma jet, and a hatched portion showing the optimum spray distance range. At this juncture, the optimum spray distance range was determined taking the adhering efficiency, the melted-solidified condition and influences upon the substrate of the spraying material into consideration. Also, the spraying material is insufficiently melted in a range above the optimum spray distance range while the substrate is inclined to be melted in a range below the optimum spray distance range.

It is found from these results that in a case where only Ar gas is used as the operation gas for the plasma jet at a ratio of 55 Nl/min, the optimum spray distance is about 28 to 35 mm and the optimum spray distance is increased nearly in proportion to an increase of the amount of $N_2$ gas with the gradual increase of the amount of $N_2$ gas with keeping the amount of Ar gas constant. The largest allowable flow rate of $N_2$ gas is 5.5 Nl/min at a flow rate of Ar gas of 55 Nl/min and the flame length is the minimum 28 mm to the maximum 63 mm within this range. Accordingly, even though the spray distance is changed from the minimum 28 mm to the maximum 63 mm, a nearly equal coating of spraying material can be obtained regardless of length of the spray distance by adjusting the mixture ratio of gas according to the change in spray distance to control the flame length.

Accordingly, it is necessary only to control the flame length by the above described method according to a depth of the damaged part 25 from the surface of the sound furnace wall 2 with maintaining the distance between the front end of nozzle of the plasma spray gun 11 and the surface of the sound furnace wall 2.

As described above, when the flow rate of $N_2$ gas is too large, an excessive heat is given to the object to be sprayed whereby the substrate is melted and damaged. On the contrary, when the flow rate of $N_2$ gas is too small, the front end of flame can not arrive at the surface of the object to be sprayed. On this account, when the powders of spraying material reached the object to be sprayed, the powders were already cooled whereby the adhering efficiency thereof to the object to be sprayed is lowered. In addition, when the mixture ratio of $N_2$ gas (the secondary gas) and Ar gas (the primary gas) is 10/100 or more, the flame length is not really increased. It is, therefore, meaningless to increase the flow rate of $N_2$ gas still more than that.

Figure 6:
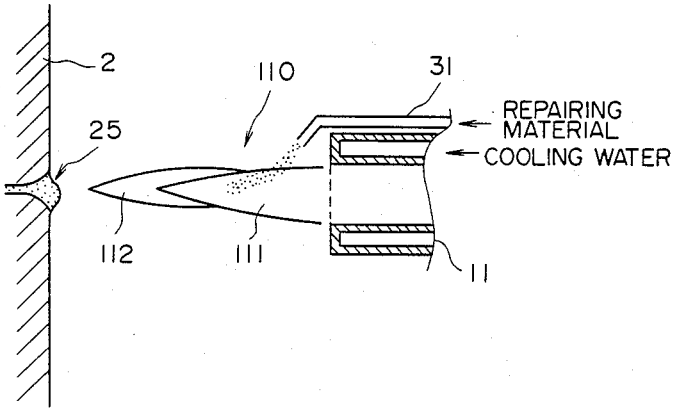
FIG. 6 is a schematic view showing a plasma flame.
Figure 7:
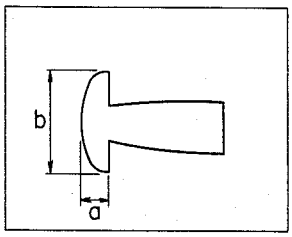
FIG. 7 is a schematic view showing a shape of a flame at an optimum spraying distance.
Figure 8A:
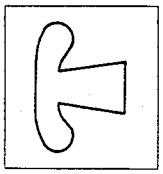
FIG. 8 is a schematic view showing a shape of a flame at an unsuitable spraying distance.
Figure 8B:
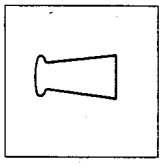
Figure 8C:
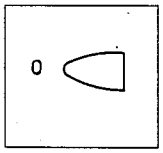

According to the present invention, the control for obtaining the optimum spray distance is carried out in the following manner:

The flame 110 radiated from the plasma spray gun 11 consists of a real plasma flame 111 and a flame 112 radiated from the repairing material heated on the side of the front end of the plasma flame 111, as shown in FIG. 6. When this flame 110 is picked up on the image by means of the television camera 13 through the filter 130 reducing the light transmission to about 1/1000, it shows a "mushroom"-like shape within the optimum spray distance range, as shown in FIG. 7. It is the reason of such shape that the front end portion of the flame 110 is seen integrally with a portion, which is diffused into the surroundings after sprayed onto the surface of the furnace wall 2, as viewed from an oblique upper side. When the spray distance is too small, a "mushroom" cap-shaped portion is widened, as shown in FIG. 8(*a*) while when the spray distance is too large, the cap-like portion is reduced in size, as shown in FIG. 8(*b*). The front end portion is separated with a further increase of spray distance, as shown in FIG. 8(*c*). Acccordingly, it can be judged from the measurement of a thickness "a" and a width "b" of the cap-like portion of the flame picked up on the image of the monitor 7, as shown in FIG. 7, whether the real spray distance is within the optimum spray distance range or not on the basis of a ratio "a/b".

The above described judgment of the optimum spray distance on the basis of the image of the flame is carried out by analyzing the image picked up by the television camera 13 for observing a flame to measure the thickness "a" and width "b" of the cap-like portion of an image of the flame shown in FIG. 7 by means of the control apparatus 9.

The control apparatus 9 controls the plasma-controlling apparatus 5 to adjust the mixture ratio of Ar gas and $N_2$ gas so that the above described ratio of the measurement value of "a" and that of "b" may be kept within the predetermined range, whereby controlling the length of the flame 110. At this time, when the ratio of the measurement value of "a" and that of "b" is not within the predetermined range, the motor 115 is driven to move the plasma spray gun 11.

In addition, since in general the optimum spray distance is dependent upon also factors such as (1) an output value of plasma, (2) a supply amount of repairing material, (3) the kind of repairing material and (4) a material of furnace wall to be repaired, a numerical value, which was previously determined from the experiments on the basis of the above described various conditions, that is to say the above described ratio of "a" and "b" is previously put in the control apparatus 9.

Next, the control of movement speed of the plasma spray gun 11 during the plasma spraying process will be described.

Since the movement speed of the plasma spray gun 11 is too small in the case that the repairing material is seen on the monitor 7 of the television camera 13 for observing a flame in the form of splash scattered during the plasma spraying process, the movement speed of the plasma spray gun 11 is increased. Also, in the case that the adhering amount of the repairing material to the furnace wall 2 seems to be too much, it is necessary only to reduce the supply amount of the repairing material by throttling the valve of the repairing material supply apparatus 3 or increase the movement speed of the plasma spray gun 11.

Also, although in the above described embodiment, the plasma spray gun 11 is automatically moved on the basis of the data of the position of the damaged part 25 stored by the control apparatus 9 and the flame length is automatically adjusted according to the depth of the damaged part 25 detected by analyzing the image picked up on the television camera 13 for observing a flame, it goes without saying that only one of the both functions may be carried out by the control apparatus and the other one may be manually operated or both functions may be manually operated.

As described above, according to the present invention, since a long and narrow damaged part such as a crack on a furnace wall can be repaired with high accuracy and efficiency, such a damaged part that is positioned in a depth of a furnace and can not be visually seen from the outside of the furnace being able to be easily repaired, and the "hot repairing" being possible without lowering a temperature of the furnace much, the operating efficiency as well as the energy efficiency are not lowered. In addition, an operator is not forced to do a dangerous operation under bad work environment, also the operation being easy, and also a lifetime of the furnace being able to be prolonged.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A repairing apparatus for a furnace wall by means of a plasma spray gun inserted into a furnace, being provided with:

the plasma spray gun using Ar gas added $N_2$ gas as an operation gas;

an image pickup apparatus for observing the furnace wall;

a position-controlling apparatus for positioning said plasma spray gun on a damaged part of the furnace wall;

a plasma-controlling apparatus for adjusting a mixture ratio of $N_2$ gas and Ar gas of the operation gas for said plasma spray gun to control a flame length of said plasma spray gun;

a repairing material supply apparatus for supplying said plasma spray gun with a repairing material of the furnace wall; and a moving mechanism for moving said plasma spray gun along the damaged part of the furnace wall wherein said moving mechanism is provided with a first moving apparatus for moving said plasma spray gun up- and downwardly and a second and a third moving apparatus for rotating said plasma spray gun in a horizontal plane and a vertical plane, whereby said repeating apparatus repairs the furnace wall by adjusting the flame length of said plasma spray gun so as to get an optimum spray distance while moving along the damaged part by controlling said moving mechanism.

2. A repairing apparatus for a furnace wall as set forth in claim 1, wherein said mixture ratio of $N_2$ gas and Ar gas ($N_2$/Ar) of the operation gas for the plasma spray gun is 10/100 or less.

3. A repairing apparatus for a furnace wall as set forth in claim 1, wherein said moving mechanism is provided with a means for moving it to an optional position on the upper surface of the furnace to be repaired.

4. A repairing apparatus for a furnace wall as set forth in claim 1, which is provided with a fourth moving apparatus by moving said plasma spray gun relative to said moving mechanism along a direction of radiating a flame radiated in the horizontal direction.

5. A repairing apparatus for a furnace wall as set forth in claim 4, wherein said plasma spray gun can be moved in three-dimensional directions by moving up-and downwardly with means of said first moving apparatus, in the direction parallel to the furnace wall with means of said first and third moving apparatus, and in the direction vertical to the furnace wall with means of said fourth moving means, under the condition that the radiation direction of the flame thereof is directed vertically to the furnace wall to be repaired.

6. A repairing apparatus for a furnace wall by means of a plasma spray gun inserted into a furnace, being provided with:

the plasma spray gun using Ar gas added $N_2$ gas as an operation gas;

an image pickup apparatus for observing the furnace wall;

a damaged position input apparatus for inputting data of damaged position in an image of said image pickup apparatus;

a position-controlling apparatus for positioning said plasma spray gun on a damaged part of the furnace wall;

a plasma-controlling apparatus for adjusting a mixture ratio of $N_2$ gas and Ar gas of the operation gas for said plasma spray gun to control a flame length of said plasma spray gun;

a repairing material supply apparatus for supplying said plasma spray gun with a repairing material of the furnace wall;

a moving mechanism for moving said plasma spray gun along the damaged part of the furnace wall wherein said moving mechanism is provided with a first moving apparatus for moving said plasma spray gun up- and downwardly and a second and a third moving apparatus for rotating said plasma spray gun in a horizontal plane and a vertical plane; and a control apparatus for storing the data of damaged position from said damaged position input apparatus and moving said plasma spray gun along the damaged part by controlling said moving mechanism on the basis of the stored data.

7. A repairing apparatus for a furnace wall as set forth in claim 6, wherein said mixture ratio of $N_2$ gas and Ar gas ($N_2$/Ar) of the operation gas for the plasma spray gun is 10/100 or less.

8. A repairing apparatus for a furnace wall as set forth in claim 6, wherein said moving mechanism is provided with a means for moving it to an optional position on the upper surface of the furnace to be repaired.

9. A repairing apparatus for a furnace wall as set forth in claim 7, which is provided with a fourth moving apparatus by moving said plasma spray gun relative to said moving mechanism along a direction of radiating a flame radiated in the horizontal direction.

10. A repairing apparatus for a furnace wall as set forth in claim 9, wherein said plasma spray gun can be moved in three-dimensional directions by moving up- and downwardly with means of said first moving apparatus, in the direction parallel to the furnace wall with means of said first and third moving apparatus, and in the direction vertical to the furnace wall with means of said fourth moving means, under the condition that the radiation direction of the flame thereof is directed vertically to the furnace wall to be repaired.

11. A repairing apparatus for a furnace wall by means of a plasma spray gun inserted into a furnace, being provided with:

the plasma spray gun using Ar gas added $N_2$ gas as an operation gas;

an image pickup apparatus for observing the furnace wall;

an image pickup apparatus for observing a flame of said plasma spray gun;

a position-controlling apparatus for positioning said plasma spray gun on a damaged part of the furnace wall;

a plasma-controlling apparatus for adjusting a mixture ratio of $N_2$ gas and Ar gas of the operation gas for said plasma spray gun to control a flame length of said plasma spray gun;

a repairing material supply apparatus for supplying said plasma spray gun with a repairing material of the furnace wall;

a moving mechanism for moving said plasma spray gun along the damaged part of the furnace wall; and a controller for controlling said plasma-controlling apparatus on the basis of the observation result obtained by said image pickup apparatus for observing a flame to adjust the mixture ratio of $N_2$ gas and Ar gas so that the flame length of said plasma spray gun may be the optimum spray distance.

12. A repairing apparatus for a furnace wall as set forth in claim 11, wherein said mixture ratio of $N_2$ gas and Ar gas ($N_2$/Ar) of the operation gas for the plasma spray gun is 10/100 or less.

13. A repairing apparatus for a furnace wall as set forth in claim 11, wherein said moving mechanism is provided with a means for moving it to an optional position on the upper surface of the furnace to be repaired.

14. A repairing apparatus for a furnace wall as set forth in claim 11, wherein said moving mechanism is provided with a first moving apparatus for moving said plasma spray gun up-and downwardly and a second and a third moving apparatus for rotating said plasma spray gun in a horizontal plane and a vertical plane.

15. A repairing apparatus for a furnace wall as set forth in claim 14, which is provided with a fourth moving apparatus by moving said plasma spray gun relative to said moving mechanism along a direction of radiating a flame radiated in the horizontal direction.

16. A repairing apparatus for a furnace wall as set forth in claim 15, wherein said plasma spray gun can be moved in three-dimensional directions by moving up- and downwardly with means of said first moving apparatus, in the direction parallel to the furnace wall with means of said first and third moving apparatus, and in the direction vertical to the furnace wall with means of said fourth moving means, under the condition that the radiation direction of the flame thereof is directed vertically to the furnace wall to be repaired.

* * * * *